United States Patent [19]

Nishikawa et al.

[11] Patent Number: 4,907,006

[45] Date of Patent: Mar. 6, 1990

[54] WIDE BAND ANTENNA FOR MOBILE COMMUNICATIONS

[75] Inventors: Kunitoshi Nishikawa, Nagoya; Mitoshi Fujimoto, Aichi, both of Japan

[73] Assignee: Kabushiki Kaisha Toyota Chuo Kenkyusho, Aichi, Japan

[21] Appl. No.: 321,271

[22] Filed: Mar. 9, 1989

[30] Foreign Application Priority Data

Mar. 10, 1988 [JP] Japan ..... 63-57206

[51] Int. Cl.[4] ..... H01Q 1/38; H01Q 9/30

[52] U.S. Cl. ..... 343/700 MS; 343/713; 343/828; 343/830

[58] Field of Search ..... 343/700 MS, 702, 828, 343/829, 830, 846, 711–713

[56] References Cited

U.S. PATENT DOCUMENTS 4,783,661 11/1988 Smith ..... 343/700 MS

*Primary Examiner*—Rolf Hille

*Assistant Examiner*—Michael C. Wimer

*Attorney, Agent, or Firm*—Oblon, Spivak, McClelland, Maier & Neustadt

[57] ABSTRACT

An antenna to be mounted on a vehicle. The antenna includes a ground plate with an L-shaped radiator plate and an L-shaped sub-radiator plate. One leg of the radiator plate and sub-radiator plate are parallel to the ground plate. The parallel legs are spaced from the ground plate. The other leg is perpendicular to the ground plate. The perpendicular leg is separated from the ground plate by a small gap. The two legs are opposed to each other with a gap between the legs parallel to the ground plate. In some embodiments, filler is placed between the plates.

15 Claims, 9 Drawing Sheets

WIDE BAND ANTENNA FOR MOBILE COMMUNICATIONS

BACKGROUND OF THE INVENTION

1. Field of the Invention

The present invention relates to an antenna to be mounted on a travelling equipment such as vehicle or the like.

2. Description of the Prior Art

The recent developments of tele-communication technology have significantly promoted the progressive applications in the fields of wire communication and especially radio communication.

In mobile radio communication systems which are able to perform the simultaneous transmission and reception of information signals such as a duplex communication system in land mobile radio-telephones and the like, the signals are modulated by the use of carriers having different frequencies. The frequencies of the respective carriers for sending and returning signals must be separated from each other sufficiently to prevent interference between two carriers.

Consequently, an antenna mounted on a vehicle must have a sufficiently widened resonant frequency band to contain said two different frequencies for transmission and reception, and it must be small and have a low profile.

In the prior art, the small antenna on the vehicle is frequently in the form of inverted F antenna shown in FIG. 11, which comprises an L-shaped radiator plate 5 having one leg connected electrically and mechanically with a ground plate 2. To make the proper impedance matching, the antenna is fed at a point which is slightly spaced away from the bent portion of the L-shaped radiator (offset feed).

Such an antenna has only a very narrow band width which is of the order of a few percent of the carrier frequency. Due to any external factors, the resonant frequency of the antenna would be frequently shifted to be forced out of the frequency bands covering the transmission and reception frequencies, resulting in interrupted transmission or reception.

Some attempts have been made to overcome the above disadvantage in the prior art. One of these attempts is that an antenna includes an auxiliary plate (sub-radiator) 11 positioned in parallel to the radiator 5, as shown in FIG. 12. The sub-radiator plate 11 is non-feed driven. Another attempt is that an additional plate 7 is positioned adjacent to the radiator 5, as shown in FIG. 13. These improvements are intended to overlap the resonant frequency bands produced by both the radiator and the sub-radiator to provide a more widened resonant frequency band such that it will not be forced away from the transmission and reception frequency band due to any external factor.

A further attempt has been made that an antenna includes an impedance compensating element 12 additionally connected with the feed line of the antenna to increase the resonant frequency band width such that the impedance matching with the feed line is provided (FIG. 14).

However, within the resonant frequency band in the prior antenna, a range in which a return loss is less than a predetermined voltage standing wave ratio (VSWR$<$2.0), that is, a range in which the return loss is less than $-10$ db could not be expected over 7%–9% in the fractional band (FIG. 15). Thus, it was not believed that the prior art can provide any improved antenna system having an increased degree of freedom with which the resonant frequency band is sufficiently widened.

In particular, the two way simultaneous transmission and reception system for automobiles, which is intended by the present invention, has an antenna surrounded by various automobile components by which the transmission and reception of the antenna would be adversely affected. It is therefore desired to provide a radio communication antenna which has a widened band width with a degree of freedom for stabilizing the transmission and reception even under the above circumstances.

SUMMARY OF THE INVENTION

It is therefore an object of the present invention to provide a wide band antenna system for mobile communications, in which a dual resonance created by a radiator and a sub-radiator is utilized to provide an increased and stabilized resonant frequency band such that the transmission and reception can be performed more freely and to provide such an antenna system which is reduced in size sufficiently to mount on an automobile and can be manufactured more easily.

To this end, the present invention provides a wide band antenna system for mobile communications, comprising a ground plate having a flat surface, an L-shaped radiator plate having one leg of L arranged parallel to said ground plate with the other leg being positioned perpendicular to said ground plate, said radiator plate being disposed having a gap between the lower end of said vertical leg and the upper surface of said ground plate, a coaxial feed cable for connecting said ground plate with an outer conductor and also for connecting an inner conductor with substantially the center of said vertical leg end of said radiator plate, and an additional conductive no-feed element (sub-radiator) formed by an L-shaped plate rigidly mounted on said ground plate at a position in close proximity to said radiator plate, said sub-radiator having one leg extending parallel to said ground plate with the end thereof being spaced away from the end of the parallel leg of said radiator plate by a given distance, the vertical leg of said L-shaped plate having the end connected with said ground plate to provide an increased band width.

In such an arrangement, the opened end of the radiator plate is located opposite to that of the sub-radiator with a given spacing therebetween. This is intended to utilize the variations of a feed point impedance due to a current induced in the sub-radiator to provide a very widened frequency band in which the real part of the impedance can be maintained, at the same value as or a value very near to the impedance of the feed line (normally equal to 50 Ohms) under a resonant condition (or when the imaginary part of the impedance is equal to zero).

In the antenna system of the present invention, there is further a given gap between the lower end of the radiator plate connected with the feed line and the upper surface of the ground plate. Such a gap provides a capacitance functioning to offset a reactance component corresponding to the imaginary part of the impedance of the antenna. When this gap was properly regulated, the imaginary part of the impedance could be maintained substantially at zero or a value substantially equal to zero over the widened frequency band width.

FIG. 2 shows the relationship between the real and imaginary parts of the feed point impedance of the antenna, relative to a frequency used by the aforementioned antenna system which is constructed according to the present invention. As seen from FIG. 2, the frequency band matching the impedance of the feed line (50 Ohms), that is, the resonant frequency band can be increased sufficiently.

In accordance with the present invention, the antenna system can have a widened frequency band (resonant frequency band) in which the sufficient number of different frequency bands can be included, since the antenna system comprises a radiator plate having its opened end opposed to the opened end of a sub-radiator element, the impedance of the feed point being regulated to create a dual resonance by the use of a current induced in the sub-radiator element. Accordingly, the transmission and reception can be carried out satisfactorily even though the antenna is adversely affected to shift the resonant frequency band by any external factor.

Thus, the antenna system of the present invention could have a fractional resonant frequency band width of 30% or higher which could match the impedance in the feed line.

Furthermore, the antenna system is of a very simplified construction and can easily realize a matching in a desired frequency band by modifying the size and shape of the antenna.

Therefore, the antenna system may be applied to various applications and is optimum for a transmitter and receiver antenna which is to be mounted on any vehicle such as automobile or the like.

Furthermore, the antenna system of the present invention can be reduced in size. In other words, the entire antenna system can be reduced in size by the fact that a dielectric material is interposed between the radiator plate and the ground plate and between the sub-radiator element and the ground plate. Where the relative dielectric constant of the dielectric material used in the antenna system of the present invention is $\epsilon r$, the shortening coefficient of wave-length is approximately represented by $$1/\sqrt{\epsilon r}.$$

This means that the effective resonant length of the antenna can be shortened by using a dielectric material having its increased relative dielectric constant.

The present invention preferably uses a material having its increased relative dielectric constant such as epoxy resin, Teflon fluorine containing polymer, glass or the like.

DETAILED DESCRIPTION OF THE PREFERRED EMBODIMENTS

Figure 1:
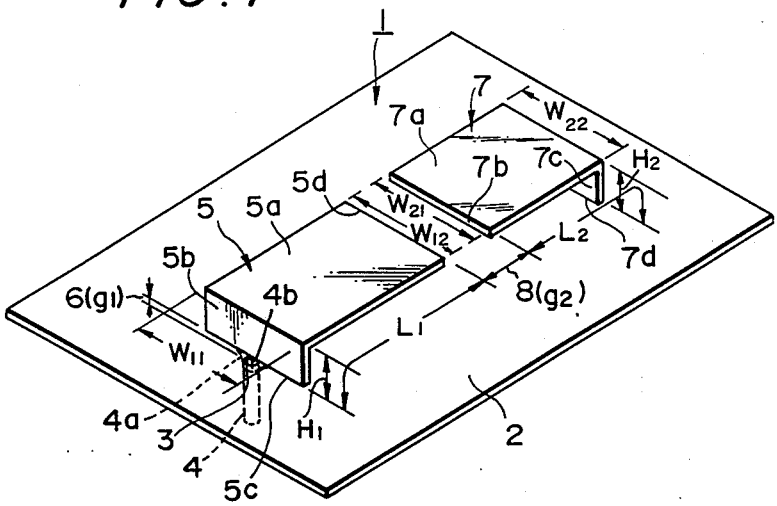
FIG. 1 is a schematic view showing the first embodiment of the present invention.
Figure 2:
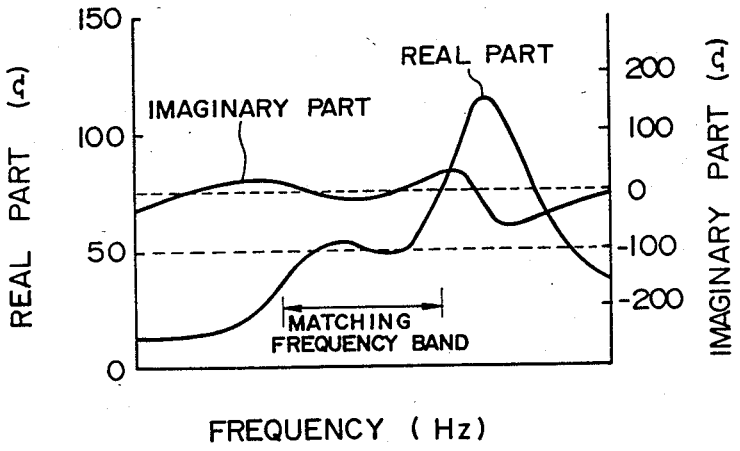
FIG. 2 is a graph showing the variations of real and imaginary parts of the antenna feed point impedance relative to various frequencies.

Referring now to FIG. 1, there is shown an antenna 1 for vehicles, which is adapted to be mounted on an automobile body and to perform the transmission and reception of radio waves between the automobile and a radio base station.

The antenna 1 comprises a ground plate 2 formed of a flat conductive plate. The ground plate 2 includes an opening 3 formed therethrough. The opening 3 receives an inner conductor (core wire) 4*b* of a coaxial feed cable 4 without electrical connection while the inner edge of the opening 3 is electrically connected with an outer conductor 4*a* of the coaxial cable 4.

On the ground plate 2 is placed a radiator plate 5. The radiator plate 5 is formed of an L-shaped conductive plate with one leg 5*a* being positioned parallel to the ground plate 3. The other or vertical leg 5*b* of the radiator plate 5 has one edge 5*c* spaced apart from the ground plate 2 by a given narrow gap 6 ($g_1$). The edge 5*c* of the radiator plate 5 is electrically connected substantially at its center with the inner conductor 4*b* of the coaxial feed cable 4.

In order to provide a widened band, a sub-radiator element 7 formed of an L-shaped conductive plate is mounted on the ground plate in proximity to the radiator plate 5 with one leg 7*a* being positioned parallel to the ground plate 2. The one leg 7*a* of the sub-radiator element 7 is located opposed to the end 5*d* of the radiator plate 5 with a given gap 8 ($g_2$) therebetween. The other or vertical leg 7*c* of the sub-radiator element 7 has one end 7*d* connected with the ground plate 2.

The length $L_1$ of the radiator plate 5 measured from the feed end 4*b* of the coaxial cable 4 to the end 5*d* of the radiator plate 5 is set to be slightly larger than one-fourth the wave-length $\lambda$ used herein while the length $L_2$ of the sub-radiator element 7 is selected to be slightly smaller than one-fourth the wave-length $\lambda$ used herein.

Various dimensions of an automobile antenna system designed for 1G Hz band in accordance with the principle of the present invention are as follows:

Length of radiator plate $L_1=70$ mm;

Width of radiator plate $W_{11}=W_{12}=50$ mm;

Height or radiator plate $H_1=20$ mm;

Gap between ground plate and radiator plate $g_1=1$ mm;

Length of sub-radiator element $L_2=45$ mm;

Width of sub-radiator element $W_{21}=W_{22}=50$ mm;

Height of sub-radiator element $H_2=20$ mm; and

Gap between ground plate and sub-radiator element $g_2=22$ mm.

Figure 3:
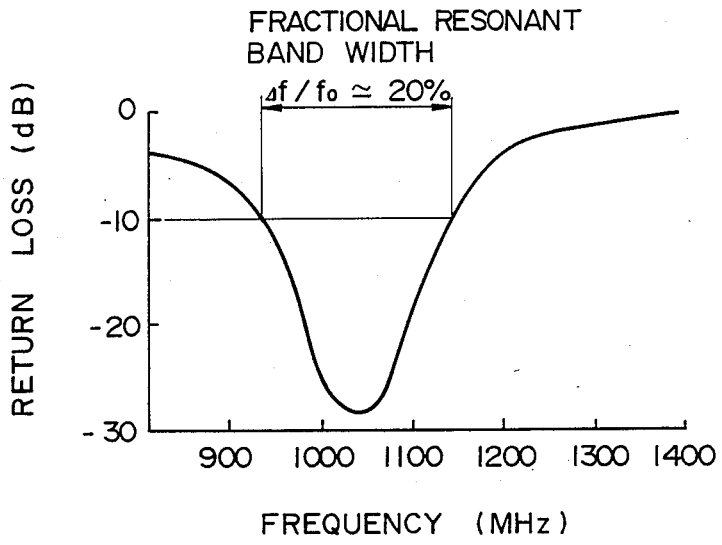
FIG. 3 is a graph showing the return loss characteristic of the antenna in the first embodiment of the present invention.

The antenna having the aforementioned dimensions has return loss characteristics shown in FIG. 3.

From this figure, it can be seen that the fractional resonant band exceeds 20% in the first embodiment of the present invention. In this connection, the fractional resonant band could be increased to 40% if the heights $H_1$ and $H_2$ of the radiator and sub-radiator plates were increased up to 30 mm respectively.

In the second embodiment, a further increased band width can be realized by regulating the widths ($W_{11}$, $W_{12}$; $W_{21}$, $W_{22}$) of the radiator and sub-radiator plates in the antenna system.

The dimensions of the second embodiment used to obtain the above advantage is as follows:

Width of radiator plate $W_{11}=50$ mm;

Width of radiator plate $W_{12}=20$ mm;

Gap between the sub-radiator element and the radiator plate $g_2=12$ mm; and

Other dimensions being the same as those of the first embodiment.

Figure 4:
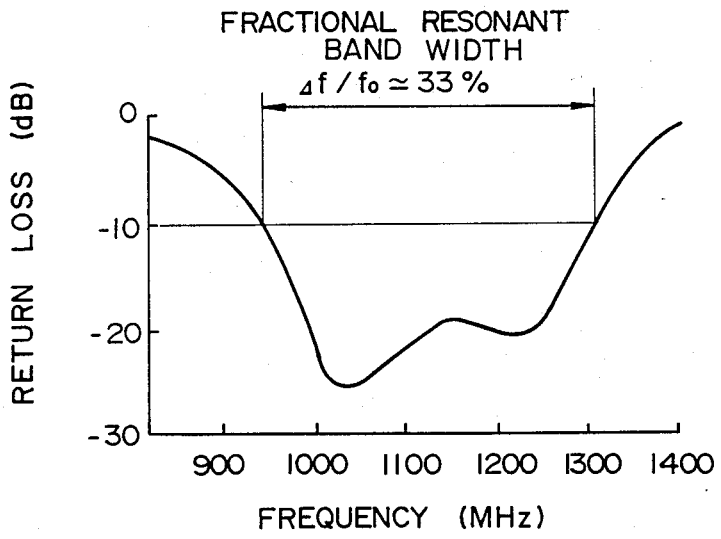
FIG. 4 is a graph showing the return loss characteristic of the antenna in the second embodiment of the present invention.

The antenna system having the above dimensions has return loss characteristics shown in FIG. 4. It can be seen from this figure that the fractional resonant band becomes 30% or more.

In such a manner, the first and second embodiments of the present invention can provide an antenna system having an increased degree of freedom which provide a widened frequency band width (resonant frequency band width) by modifying the size and shape of the antenna.

Figure 5:
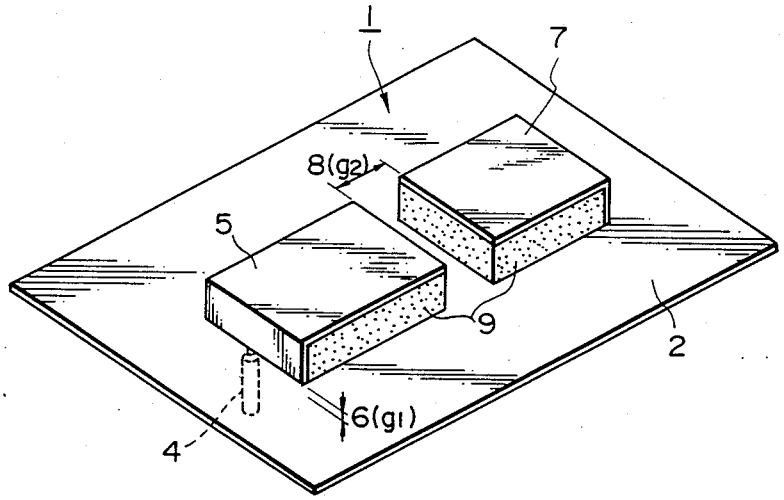
FIG. 5 is a schematic view of the third embodiment of the present invention.

Referring now to FIG. 5, there is shown in the third embodiment providing an antenna system 1 which is further reduced in size and has an increased mechanical strength.

In the third embodiment, fillers each formed of a dielectric material having its good high-frequency characteristics, such as Teflon fluorine-containing polymer epoxy resin, glass or the like are interposed between the ground plate 2 and the radiator plate 5 and between the ground plate 2 and the sub-radiator element 7. In such a case, the Teflon fluorine-containing polymer fillers 9 have their relative dielectric constant $\epsilon r=2.6$. Thus, the size of the entire antenna could be reduced up to about 20%. Further, the interposition of the fillers 9 permits the antenna system to withstand vibrations from the vehicle on which it is mounted.

Figure 6:
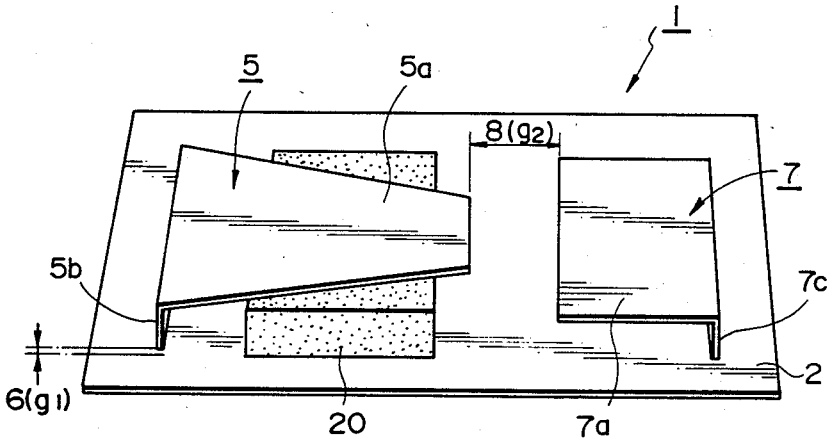
FIG. 6 is a schematic view of the fourth embodiment of the present invention in whic a radiator plate is supported by a supporter relative to a ground plate.

FIG. 6 shows the fourth embodiment of the present invention having a structure similar to that of the first embodiment shown in FIG. 1, wherein an L-shaped radiator plate 5 is floated above a ground plate 2 with a gap 6 ($g_1$) formed therebetween.

In the fourth embodiment, the radiator plate 5 has one leg 5*a* placed on a supporter 20 parallel to the ground plate 2. Such an arrangement supports the radiator plate 5 above the ground plate 2 while maintaining the gap 6 ($g_1$) properly.

The supporter 20 is preferably made of any suitable electrically insulating material such as foamed styrene or the like.

Figure 7:
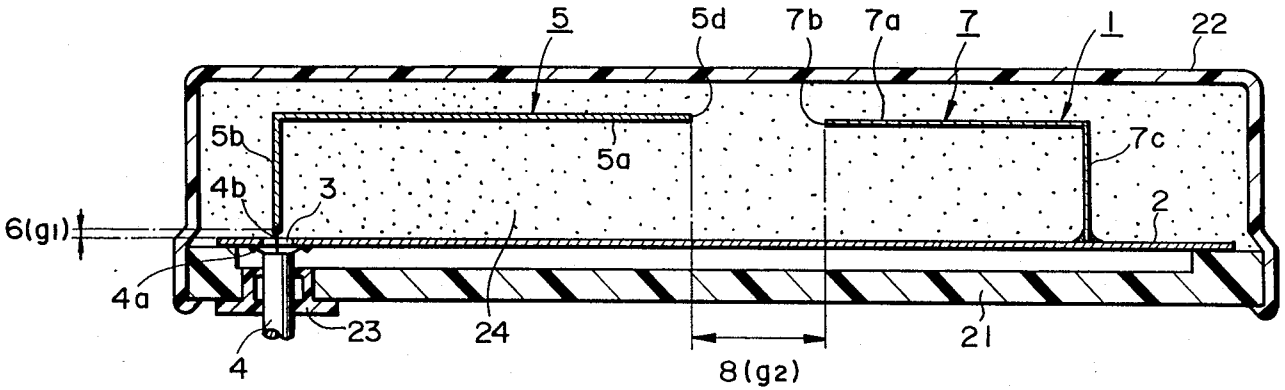
FIG. 7 is a cross-sectional view of the fifth embodiment of the present invention in which a radiator plate is spaced away from a ground plate by a given gap and rigidly supported on the ground plate by mean of a molding resin.

FIG. 7 shows the fifth embodiment of the present invention in which an antenna system 1 is mounted within a casing. The casing comprises a base plate 21 and a closure 22, both of which are made of any suitable electrically insulating material such as plastic material or the like.

A ground plate 2 is rigidly mounted on the base plate 21 by any suitable joining means such as adhesion or the like.

The base plate 21 also rigidly supports a coaxial cable 4 by clip means such that the coaxial cable 4 is introduced into the casing. The coaxial cable 4 includes an outer conductor 4*a* joined to the ground plate 2 and an inner conductor 4*b* connected with the vertical leg 5*b* of an L-shaped radiator plate 5 at its edge.

As seen from FIG. 7, an L-shaped sub-radiator element 7 has its vertical leg 7*c* rigidly connected at one end with the ground plate 2 by any suitable joining means such as welding or the like. On the other hand, a molding resin 24 is charged into the casing such that the radiator plate 5 is rigidly mounted on the ground plate 2 with a gap 6 ($g_1$) formed therebetween. The molding resin is preferably of foamed styrene or Teflon fluorine-containing polymer.

In the fifth embodiment, the radiator plate 5 can be properly positioned relative to the ground plate 2 with the gap formed therebetween, by the use of the molding resin.

Figure 8:
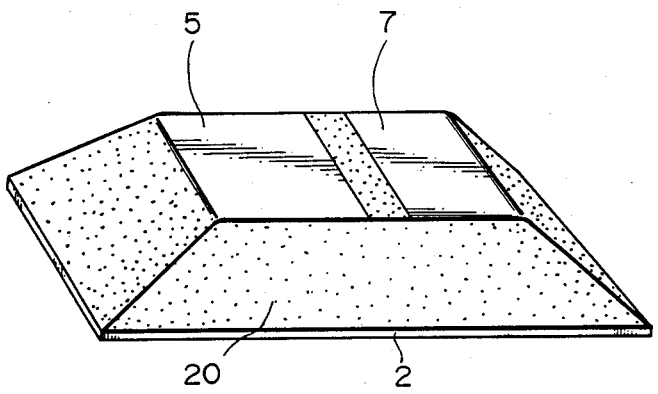
FIG. 8 is a schematic view of the sixth embodiment of the present invention in which a radiator plate and a sub-radiator element are molded by a supporter having sloping outer wall faces.
Figure 9:
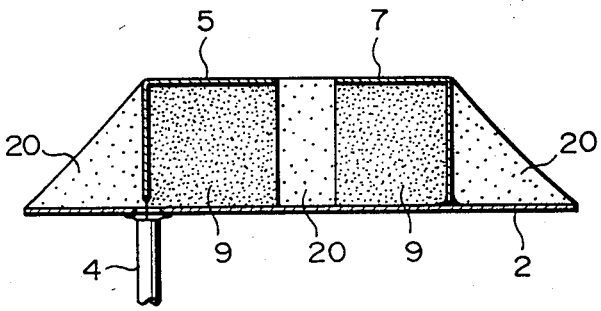
FIG. 9 is a cross-sectional view of the sixth embodiment shown in the FIG. 8.

FIGS. 8 and 9 show the sixth embodiment of the present invention in which an L-shaped radiator plate 5 and a similar L-shaped sub-radiator element 7 are supported on a ground plate 2 by means of fillers 9 and further covered by supporter 20 having the shape of a frustum of a pyramid.

In the embodiment, the fillers are made of dielectric material which has good high-frequency characteristics. Teflon fluorine-containing polymer, epoxy resin or glass are preferable to provide such dielectric material. Molded resin is interposed between the ground plate 2 and the radiator plate 5 to make a slightly narrow channel therebetween for supporting the radiator plate 5 in separated disposition above the ground plate 2. On the other hand, the sub-radiator element 7 is rigidly mounted on the ground plate 2 with the parallel leg thereof being opposed to the parallel leg of the radiator plate 5. The spaced room between the sub-radiator 7 and the ground plate 2 is then filled with molded resin for increasing the dielectric constant of the sub-radiator.

The antenna of the embodiment is further molded by supporter 20 being made of foamed styrene for example to solidify the shape of the antenna. Molding the supporter 20 provides the external shape of a frustum of a pyramid to the antenna in which the upper surfaces of the radiator plate 5 and the sub-radiator element 7 are exposed outwardly. Such a frustum of a pyramid shaped supporter 20 can protect the antenna from collision or mechanical shock. As shown in the figures the molding supporter 20 can cover the radiator plate 5 and the sub-radiator element 7 except their upper surfaces for securely mounting the plate 5 and the element 7 on the ground plate 2. According to the shape of a frustum of a pyramid, the supporter 20 has sloping outer wall faces on its four sides so as to provide the rounding off shape on the outer surface thereof. The above mentioned shape is preferable to realize a well-formed design for an antenna equipment being placed on the back seat tray of the automobiles.

Figure 10:
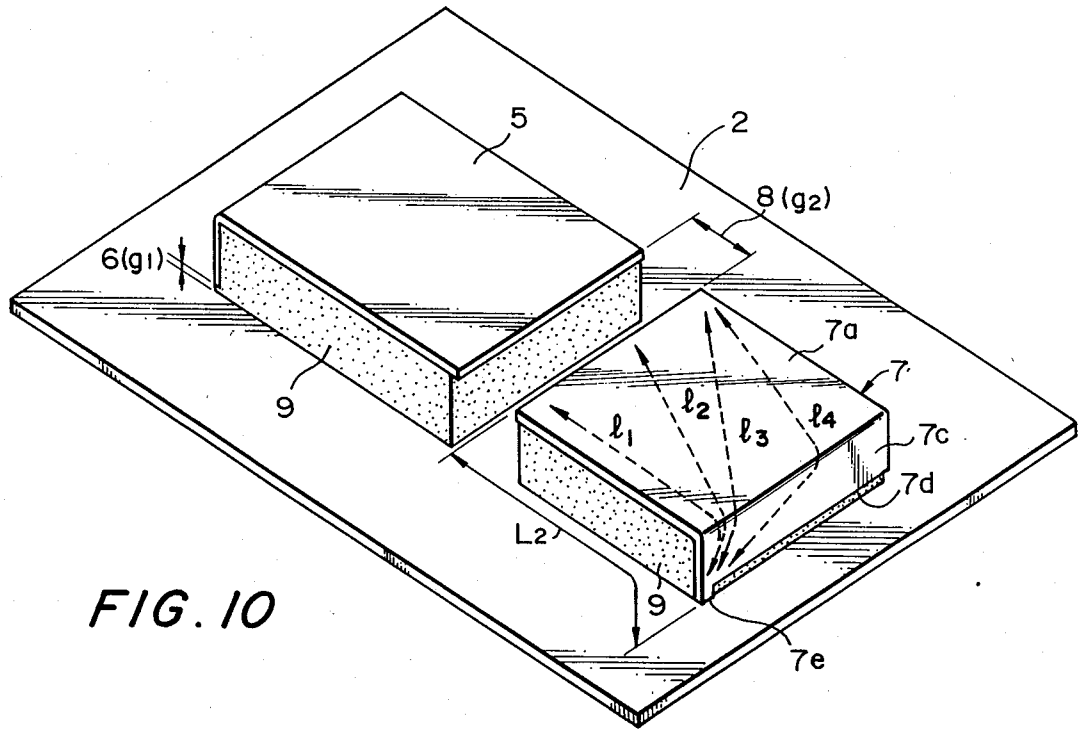
FIG. 10 is a schematic view of the seventh embodiment of the present invention in which a sub-radiator element is electrically connected with a ground plate through a narrow bridge portion.
Figure 11:
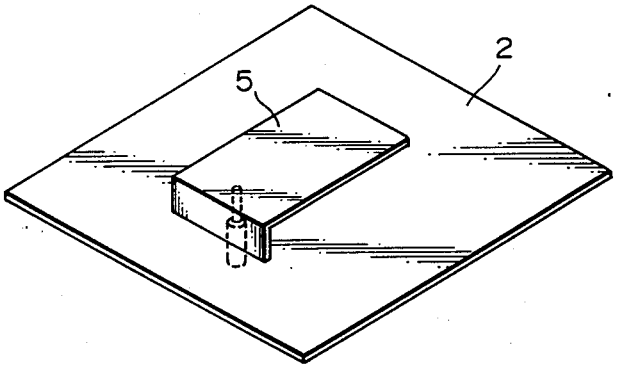
FIG. 11 PRIOR ART
FIGS. 11, 12, 13 and 14 are schematic views showing various antenna configurations in the prior art.
Figure 12:
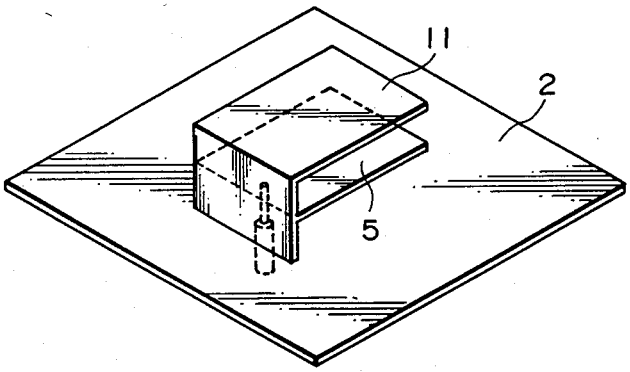
FIG. 12 PRIOR ART
Figure 13:
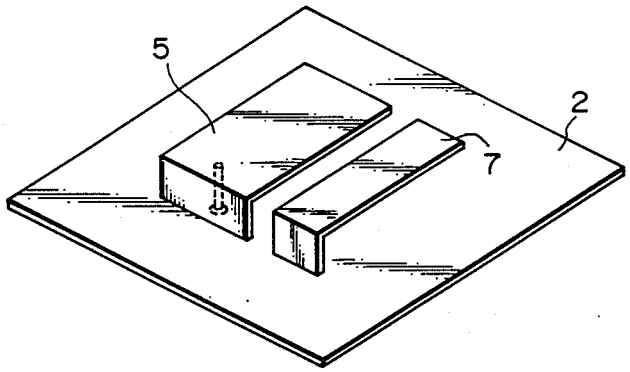
FIG. 13 PRIOR ART
Figure 14:
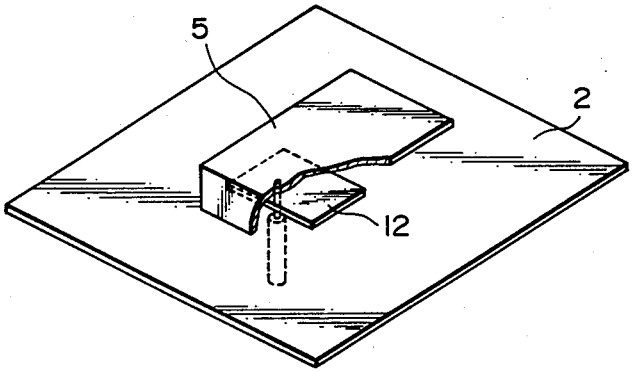
FIG. 14 PRIOR ART
Figure 15:
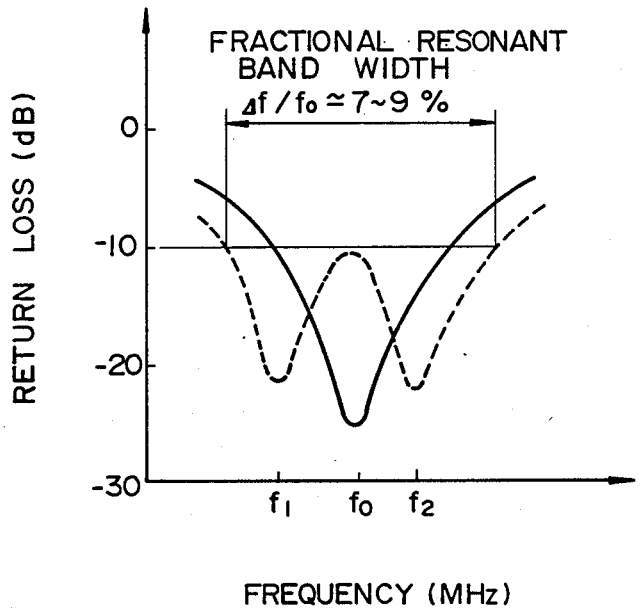
FIG. 15 PRIOR ART
FIG. 15 is a graph showing the variations of return loss relative to various frequencies in an antenna system constructed according to the prior art.

FIG. 10 shows the seventh embodiment of the present invention which is similar to the third embodiment shown in FIG. 5. In contrast to the third embodiment, the sub-radiator element 7 of the present embodiment has a connecting bridge portion 7*e* for making an electrical conductivity between the sub-radiator 7 and the ground plate 2 within a restricted narrow path. Accordingly the remain of the end portion 7*d* of the sub-radiator element 7 is kept in electrically insulated relation to the ground plate 2. The bridge protion 7*e* is preferably provided to one side of the vertical leg 7*c* of the sub-radiator element 7.

By restricting the electrical conductivity path between the element 7 and the ground plate 2, induced electric current in the element 7 on receiving radio waves will make a plurality of current paths shown $l_1$–$l_4$ in FIG. 10 since the end of the paths is closed tight to the connecting bridge protion 7*e*. The length of each path is therefore different from the other, for instance, path $l_4$ is larger than path $l_3$ and so on. As well known in the art, the length of the induced current path will define the wavelength of the received radio signals, therefore, the different length of the paths can widen the resonant frequency of the sub-radiator 7. Accordingly, the seventh embodiment shown in FIG. 10 can provide an antenna having a widened resonant band width.

Although the bridge portion 7*e* of the shown embodiment is composed in the projected portion from the vertical leg 7*c* of the element 7, the bridge of this invention can be formed by a solder conductivity path, a lead wire or the like.

We claim:

1. An antenna device for vehicles, comprising a ground plate having a flat surface, and L-shaped radiator plate having one leg of the L shape arranged parallel to said ground plate with the other leg being positioned perpendicular to said ground plate, said radiator plate being disposed having a narrow gap between an end of said perpendicular leg and the upper surface of said ground plate, a feed coaxial cable for connecting said ground plate with an outer conductor and also for connecting an inner conductor with substantially the center of the end of said perpendicular leg of said radiator plate, and a sub-radiator element formed by an L-shaped plate rigidly mounted on said ground plate at a position in close proximity to said radiator plate, said sub-radiator element having one leg extending parallel to said ground plate with the end thereof being spaced away from the end of the parallel leg of said radiator plate by a given distance, and a perpendicular leg of said L-shaped plate of said sub-radiator element having the end thereof connected with said ground plate to provide an increased resonant band width.

2. An antenna device as defined in claim 1, further comprising filler means for surrounding said ground plate, said radiator plate and said sub-radiator element, said filler means being made of dielectric material which has good high-frequency characteristics.

3. An antenna device as defined in claim 1, filler means at least interposed between the ground plate and the radiator plate and between the ground plate and the sub-radiator element.

4. An antenna device as defined in claim 3 wherein said filler means is made of one selected from fluorine-containing polymers, epoxy resin or glass.

5. An antenna device as defined in claim 3, further comprising support means covering the part of the outer surfaces of said radiator plate and said sub-radiator element for rigidly mounting said radiator plate and said sub-radiator plate on said ground plate.

6. An antenna device as defined in claim 5, the outer surface of said support means has sloping outer wall faces the rounding off the surface thereof.

7. An antenna device as defined in claim 6, wherein said support means is made of foamed styrene.

8. An antenna device as defined in claim 1, further comprising support means for rigidly mounting said radiator plate on said ground plate with the end of the vertical leg of said radiator plate being floated above said ground plate by a given narrow gap therebetween, said support means being made of an electrically insulating material.

9. An antenna device as defined in claim 8 wherein said support means is made of foamed styrene.

10. An antenna device as defined in claim 8 wherein said support means includes a molding resin which is set to surround said radiator plate and said sub-radiator element with said radiator plate being spaced away from said ground plate by said given narrow gap.

11. An antenna device as defined in claim 1 wherein the length of said radiator plate ($L_1$) is set to be slightly larger than one-fourth the wave-length $\lambda$ of a frequency carrier wave and wherein the length of said sub-radiator element ($L_2$) is set to be slightly smaller than one-fourth the wave-length $\lambda$ of the frequency carrier wave.

12. An antenna device as defined in claim 4 wherein the length of said radiator plate ($L_1$) is set to be slightly larger than one-fourth the wave-length $\lambda$ of a frequency carrier wave and wherein the length of said sub-radiator element ($L_2$) is set to be slightly smaller than one-fourth the wave-length $\lambda$ of the frequency carrier wave.

13. An antenna device as defined in claim 8 wherein the length of said radiator plate ($L_1$) is set to be slightly larger than one-fourth the wave-length $\lambda$ of a frequency carrier wave and wherein the length of said sub-radiator element ($L_2$) is set to be slightly smaller than one-fourth the wave-length $\lambda$ of the frequency carrier wave.

14. An antenna device for vehicles, comprising a ground plate having a flat surface, an L-shaped radiator plate having one leg of the L shape arranged parallel to said ground plate with the other leg being positioned perpendicular to said ground plate, said radiator plate being disposed having a narrow gap between an end of said perpendicular leg and the upper surface of said ground plate, a feed coaxial cable for connecting said ground plate with an outer conductor and also for connecting an inner conductor with substantially the center of the end of said perpendicular leg of said radiator plate, and a sub-radiator element formed by an L-shaped plate being disposed close to said ground plate at a position in opposite proximity to said radiator plate, said sub-radiator element having one leg extending parallel to said ground plate with the end thereof being spaced away from the end of the parallel leg of said radiator plate by a given distance, and a perpendicular leg of said L-shaped plate of said sub-radiator element having a connecting bridge portion thereof rigidly connected with said ground plate at one side of the perpendicular leg to widen a resonant band width.

15. An antenna device as defined in claim 14 further comprising filler means for surrounding said ground plate, said radiator plate and said sub-radiator element, said filler means being made of dielectric material which has good high-frequency characteristics; wherein the length of said radiator plate ($L_1$) is set to be slightly larger than one-fourth the wave-length $\lambda$ of a frequency carrier wave and wherein the length of said sub-radiator element ($L_2$) is set to be slightly smaller than one-fourth the wave-length $\lambda$ of the frequency carrier wave.

* * * * *